US006786754B2

(12) United States Patent
Yamaoka et al.

(10) Patent No.: US 6,786,754 B2
(45) Date of Patent: Sep. 7, 2004

(54) CONNECTOR AND A CONNECTOR ASSEMBLY

(75) Inventors: Atsushi Yamaoka, Yokkaichi (JP); Yukinori Saka, Yokkaichi (JP); Koji Okutani, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/642,983

(22) Filed: Aug. 18, 2003

(65) Prior Publication Data

US 2004/0038569 A1 Feb. 26, 2004

(30) Foreign Application Priority Data

Aug. 22, 2002 (JP) ..... 2002-242111

(51) Int. Cl.[7] ..... H01R 13/627
(52) U.S. Cl. ..... 439/352; 439/153
(58) Field of Search ..... 439/153, 157, 439/159, 352

(56) References Cited

U.S. PATENT DOCUMENTS 6,241,542 B1 6/2001 Nishide et al.
6,358,081 B1 * 3/2002 Saka et al. ..... 439/352
6,475,014 B2 * 11/2002 Tsuji et al. ..... 439/352
6,524,125 B2 * 2/2003 Nakamura ..... 439/352

* cited by examiner

*Primary Examiner*—Renee Luebke
(74) *Attorney, Agent, or Firm*—Gerald E. Hespos; Anthony J. Casella

(57) ABSTRACT

A connector has a housing (20) with a lock arm (28) that engages a lock (13) of a mating housing (10) when the housings (10, 20) are connected properly. Resilient members (50) are movable along a connecting direction (CD) of the housings (20, 10) and are displaceable along a direction (RDD) intersecting the connecting direction (CD). The resilient members (50) are pushed back by the mating housing (10) as the housings (20, 10) are connected. A spring (70) between the resilient member (50) and the housing (20) accumulates a biasing force to separate the housings (20, 10) as the resilient member (50) is moved back. An operable member (40) is movable along the connecting direction (CD) and has an operating portion (80) displaceable to an operable position where the lock arm (28) can be operated to cancel the locked state.

12 Claims, 15 Drawing Sheets

CONNECTOR AND A CONNECTOR ASSEMBLY

BACKGROUND OF THE INVENTION

1. Field of the Invention

The invention relates to connectors that prevent partial connection.

2. Description of the Related Art

U.S. Pat. No. 6,241,542 and FIGS. 14(A), 14(B), 15(A) and 15(B) herein show a connector for an automotive airbag circuit. With reference to FIGS. 14(A), 14(B), 15(A) and 15(B), the connector has male and female housings 1 and 2 that are connectable with one another. The male housing 1 has a resiliently deformable lock arm 3 that moves onto a lock 4 of the female housing 2 as the housings 1, 2 are connected. A slider 5 is assembled with the male housing 1 and is held against backward movement by the deformed lock arm 3. A spring 6 is provided in the slider 5 and is compressed by a rib 7 of the female housing 2. Thus, a biasing force is accumulated in the spring 6. The biasing force of the spring 6 is released to separate the housings 1, 2 if the connecting operation is interrupted with the housings 1, 2 only partly connected.

The lock arm 3 returns to engage the lock 4 and to release the slider 5 when the housings 1, 2 are connected properly. Thus, the biasing force in the spring 6 is released and moves the slider 5 back. A restricting portion 8 of the slider 5 enters a deformation space above the lock arm 3.

The housings 1, 2 can be separated by moving the slider 5 forward sufficiently for the restricting portion 8 to clear the lock arm 3. The lock arm 3 then is deformed away from the lock 4 and the male housing 1 is pulled back. Thus, separation of the housings 1, 2 requires successive operations of pushing the slider 5 forward and pulling the male housing 1 back. Movement of the male housing 1 and the slider 5 in opposite directions is cumbersome and inefficient.

SUMMARY OF THE INVENTION

The invention relates to a connector having a housing connectable with a mating housing of a mating connector. The housing comprises a lock arm that is resiliently engageable with a lock of the mating housing when the housing is connected properly with the mating housing. At least one resilient member is assembled for movement substantially along a connecting direction of the two housings. The resilient member can be pushed back by a pushing portion on the mating housing in the process of connecting the housings. Additionally, the resilient member is displaceable in direction that intersects the connecting direction. A biasing member is provided between the resilient member and the connector and is compressible while accumulating a biasing force to separate the housings as the resilient member is moved back. An operable member is movable substantially along the connecting direction and has a movable operating portion displaceable between an operable position where the lock arm can be operated to cancel the locked state of the lock arm and an inoperable position where the lock arm cannot be operated.

The pushing portion pushes the resilient member back as the housings are connected. Thus, the biasing member is compressed between the resilient member and the housing. The operable member can be held and prevented from forward movement with respect to the housing. Accordingly, a connecting operation can be performed by operating the operable member.

The connecting operation could be interrupted halfway. In this situation, biasing forces accumulated in the biasing member are released and separate the housings. Thus, the housings cannot be left partly connected.

The operable member is operated and moved back to separate the two properly connected housings. More particularly, the operable member prevents the resilient member from moving any further forward and moves back together with the operable member while resiliently compressing the biasing member. The movable operating portion can be displaced from the inoperable position to the operable position in this state. Thus, the lock arm is operated by the movable operating portion to cancel the locked state of the resilient member with the lock. The biasing force of the biasing member then is released to move the other housing backward with respect to the mating connector housing.

As described above, the operable member is operated in the same direction as the housing to separate the two housings. Thus, separating efficiency is good. Further, the lock arm cannot be operated unless the movable operating portion is displaced from the inoperable position to the operable position during the separating operation. Thus, the locked state of the properly connected housings cannot be canceled inadvertently. The two housings can be connected and separated by operating the operable member. Thus, operability is better than in connectors where the housing is operated during connecting and an operable member is operated during separation.

The housing preferably comprises at least one canceling portion for displacing the resilient member to cancel the pushed state by the pushing portion as or after the housings are connected properly.

The lock arm engages the lock as the two housings are connected properly to lock the two housings together. However, the resilient member is displaced by the canceling portion to cancel the pushed state of the resilient member by the pushing portion. Thus, the biasing force accumulated in the biasing member is released to move the resilient member forward.

The operable member preferably is assembled with the housing and held so as not to move any further forward.

The operable member preferably is adapted to support the resilient member so that the resilient member does not move any further forward.

Most preferably, the resilient member is made of a metal.

The resilient member preferably is arranged so that the pushing portion is formed by a front end surface of the mating housing.

The operable member preferably can be moved substantially in a removing direction of the housing for bringing the movable operating portion to the operable position.

The movable operating portion may comprise an operable projection surrounded by at least one raised portion on the operable member. The raised portion may comprise a slanted front surface sloped up to the back.

The operable member preferably is held at the initial mount position by the biasing member so as not to move any further back with respect to the housing.

A forward-acting force is exerted on the operable member by an inertial force and by the contact of the resilient member with front-stops of the operable member when the two housings are connected to a specified depth immediately before proper connection. As a result, the housings can be pushed automatically to a proper depth of connection.

The movable operating portion preferably can be displaced from the inoperable position to the operable position by pulling the operable member and pressing an operable projection of the operable to displace the lock arm resiliently.

The invention also relates to a connector assembly comprising the above-described connector and a mating connector connectable therewith. The mating connector comprises a mating housing with a lock and the connector comprises housing with a lock arm for engaging the lock when the housings are connected properly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is illustrated in FIGS. 1 to 13, and is intended for use in an automotive airbag circuit or similar security environment. This connector has male and female housings 10, 20 that are connectable with each other. The male housing 10 is mounted directly to a piece of equipment and the female housing 20 is mounted to ends of unillustrated wires. In the following description, connecting surfaces of the housings 10, 20 (e.g. left side in FIGS. 4 and 5) are referred to as the front and reference is made to FIGS. 1 and 8 concerning the vertical direction.

Figure 8A:
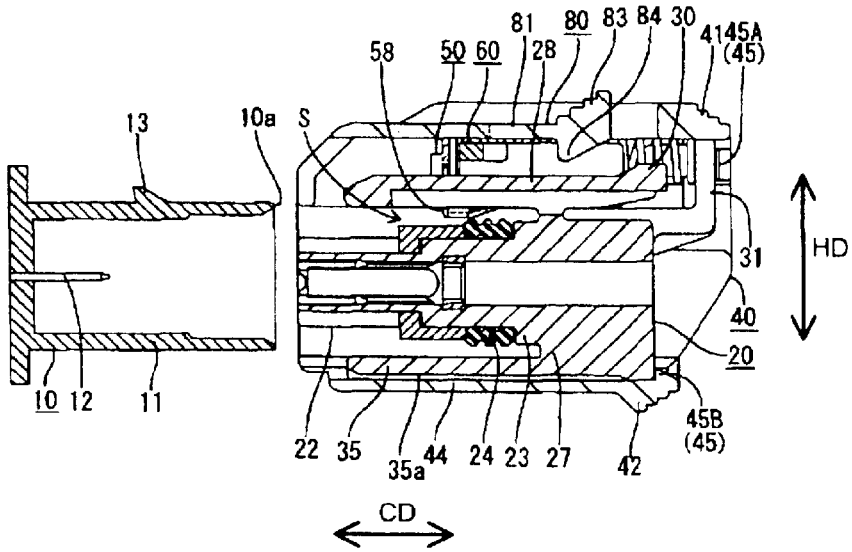
FIGS. 8(A) and 8(B) are sections along 8(A)—8(A) and 8(B)—8(B) of FIG. 6 showing a state before the female housing and a male housing are connected.
Figure 8B:
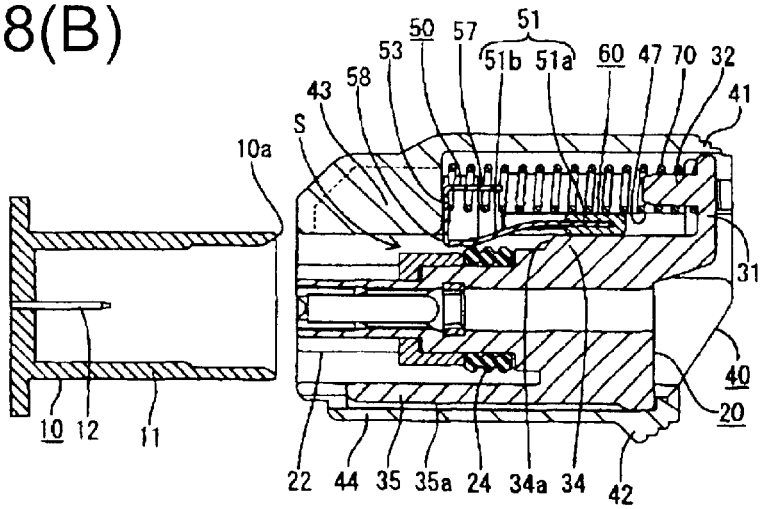

The male housing 10 is made e.g. of a synthetic resin and has a wide tubular receptacle 11 that projects forward, as shown in FIG. 8. Four tab-shaped male terminal fittings 12 project from the back end surface of the male housing 10 and are surrounded by the receptacle 11. A lock 13 projects up at a widthwise middle of the upper surface of the receptacle 11. The lock 13 has a front surface that slopes up and to the back and an undercut rear surface that slopes slightly down and to the front.

The female housing 20 is made e.g. of a synthetic resin and has four cavities 21 arranged side-by side in a terminal accommodating portion 22. Female terminal fittings (not shown) connected with wires are insertable from behind into the cavities 21 along an insertion direction ID. The terminal accommodating portion 22 is dimensioned to telescope into the receptacle 11 of the male housing 10.

The terminal accommodating portion 22 is stepped at two positions to make a rear part wider than a front part, and the receptacle 11 is fittable over a front stepped portion 23. A seal ring 24 is mounted immediately before the front stepped portion 23 and can be squeezed between the terminal accommodating portion 22 and the inner peripheral surface of the receptacle 11 to provide sealing between the two housings 10, 20. A retainer 25 is mountable on the terminal accommodating portion 22 immediately before the seal ring 24 and is movable along a widthwise direction WD substantially normal to the inserting direction ID between a partial locking position and a full locking position. The retainer 25 at the partial locking position is retracted from the cavities 21 to permit insertion and withdrawal of the female terminal fittings. However, the retainer 25 at the full locking position enters the cavities 21 to engage and lock the female terminal fittings. A section of the front part of the terminal accommodating portion 22 where the retainer 25 is mounted is formed with an escaping portion 26.

Figure 4:
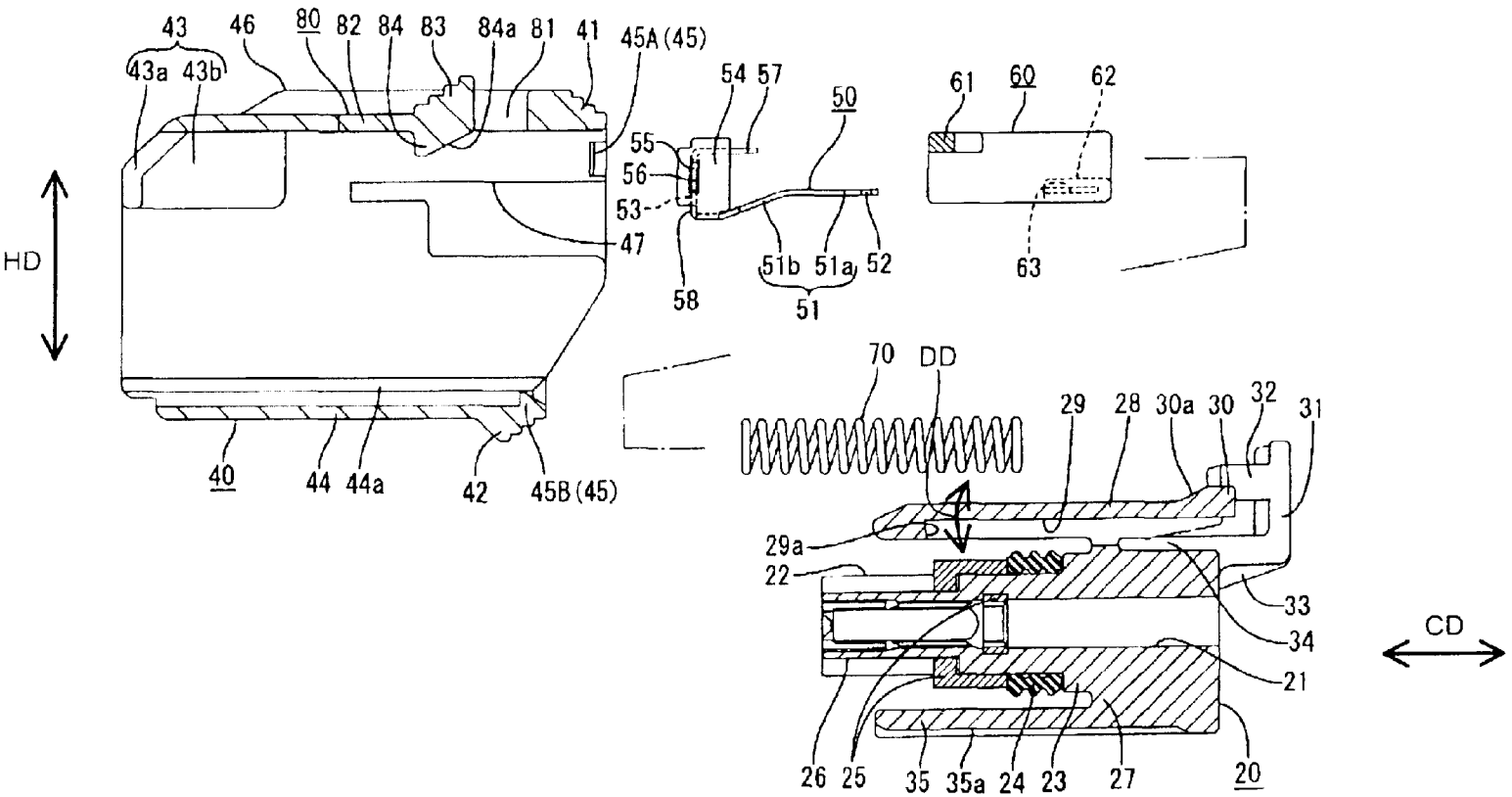
FIG. 4 is an exploded section along 4—4 of FIG. 1.

The terminal accommodating portion 22 has a rear stepped portion 27 and an upper widthwise middle of the rear stepped portion 27 is recessed. A seesaw-shaped lock arm 28 is formed in the recess. The lock arm 28 has a projection that extends from the terminal accommodating portion 22 and arms that extend forward and back from the projection. The lock arm 28 is resiliently displaceable about the projection so that the arms move up and down along a displacement direction DD (FIGS. 4, 10). The displacement direction DD is substantially normal to a connecting direction CD of the female and male housings 20, 10. A backwardly open groove 29 is formed in the lower surface of the lock arm 28, and a front end surface 29*a* of the groove 29 is engageable with the lock 13. The front end surface 29*a* of the groove 29 is undercut to slope slightly down and to the back to enhance a holding force for the two housings 10, 20. An unlock guide 30 projects up and out over substantially the entire width at the rear end of the upper surface of the lock arm 28. A slanted surface 30*a* is formed at the front of the unlock guide 30 and slopes up and to the back.

Two spring supports 31 are provided at the rear end of the terminal accommodating portion 22 and at opposite sides of the lock arm 28 for supporting the rear ends of compression coil springs 70 assembled into the female housing 20. The spring supports 31 project back and then out to define a substantially L-shape when viewed sideways. Substantially cylindrical engaging projections 32 project forward from the projecting sections of the spring supports 31 and fit into the rear ends of the compression coil springs 70. Reinforcing ribs 33 are provided on the lower surfaces of the backward-projecting sections of the spring supports 31 and are coupled with the terminal accommodating portion 22. Vertically long ribs project from the outer edges of the standing-up sections and have a shorter dimension than the engaging projections 32 along forward and backward directions.

Figure 1:
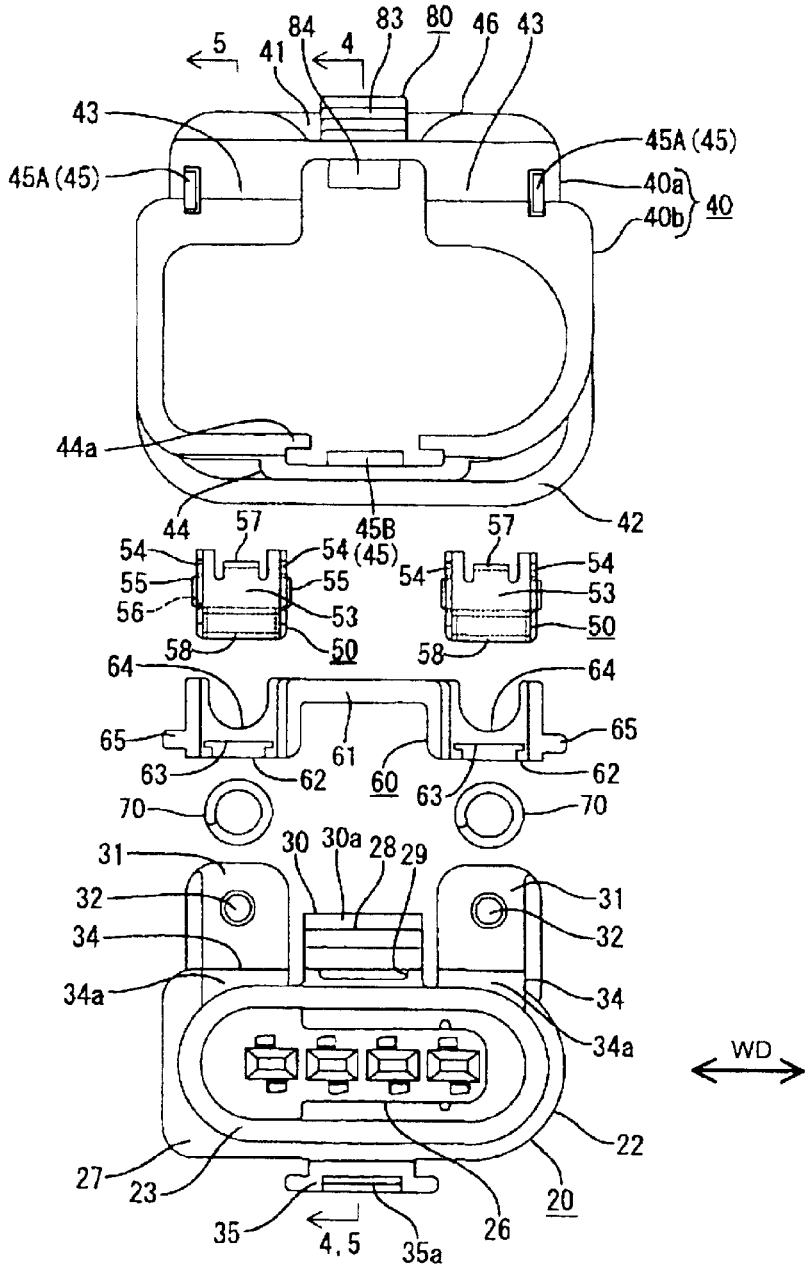
FIG. 1 is an exploded front view of a female housing, compression coil springs, a slide, resilient members and a cover according to an embodiment of the invention.
Figure 2:
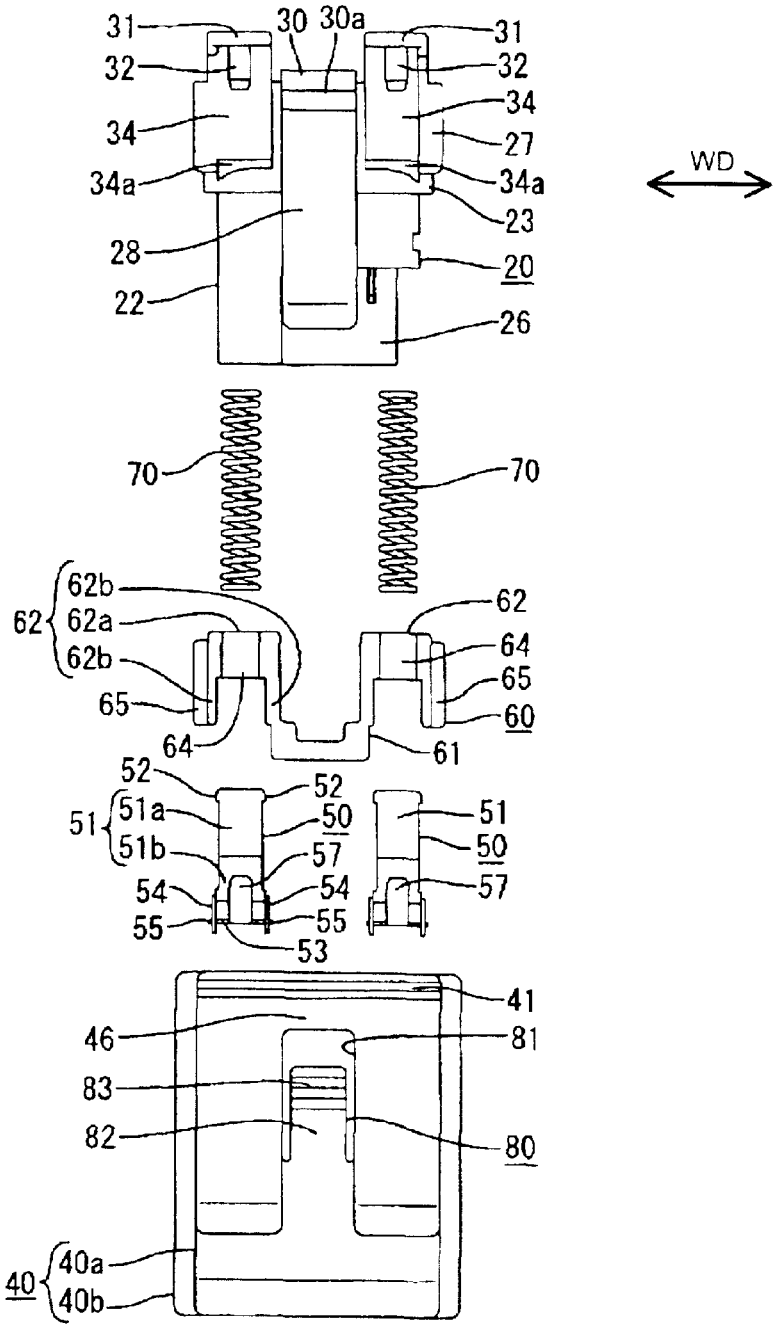
FIG. 2 is an exploded plan view of the female housing, the compression coil springs, the slide, the resilient members and the cover.
Figure 3:
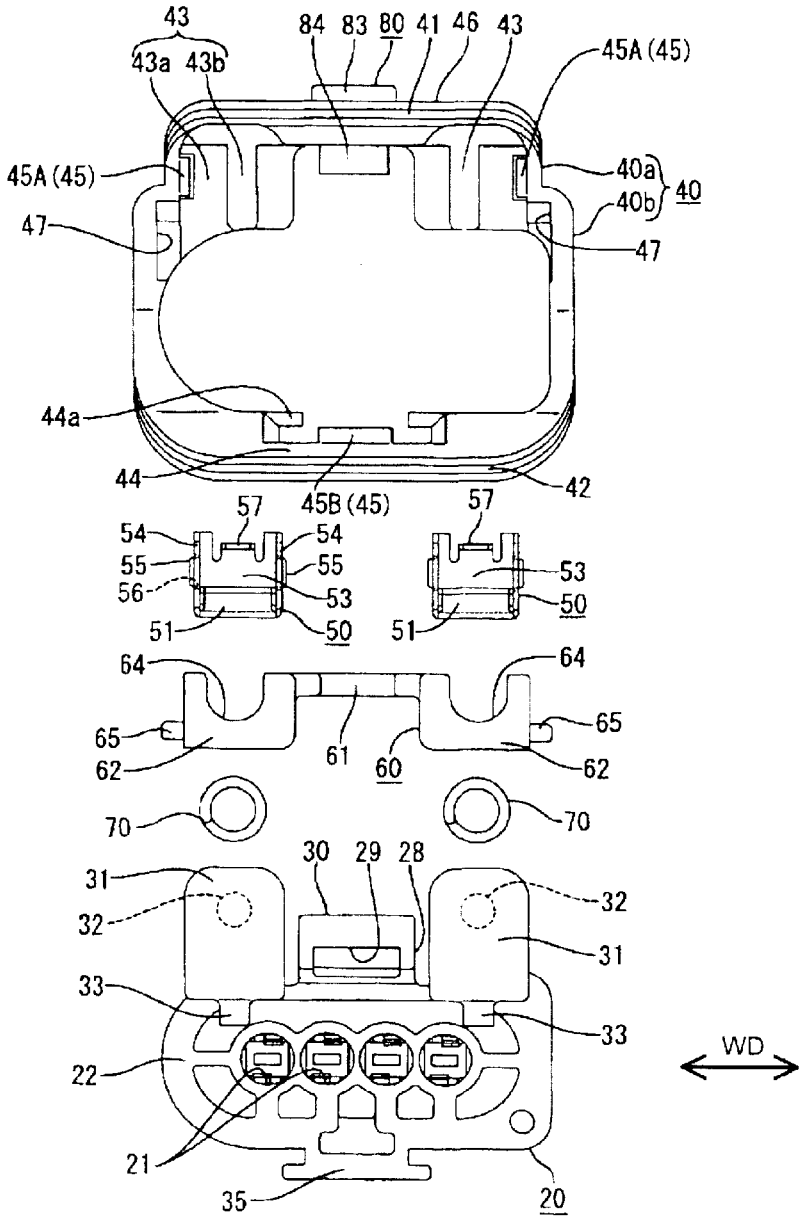
FIG. 3 is an exploded rear view of the female housing, the compression coil springs, the slide, the resilient members and the cover.
Figure 5:
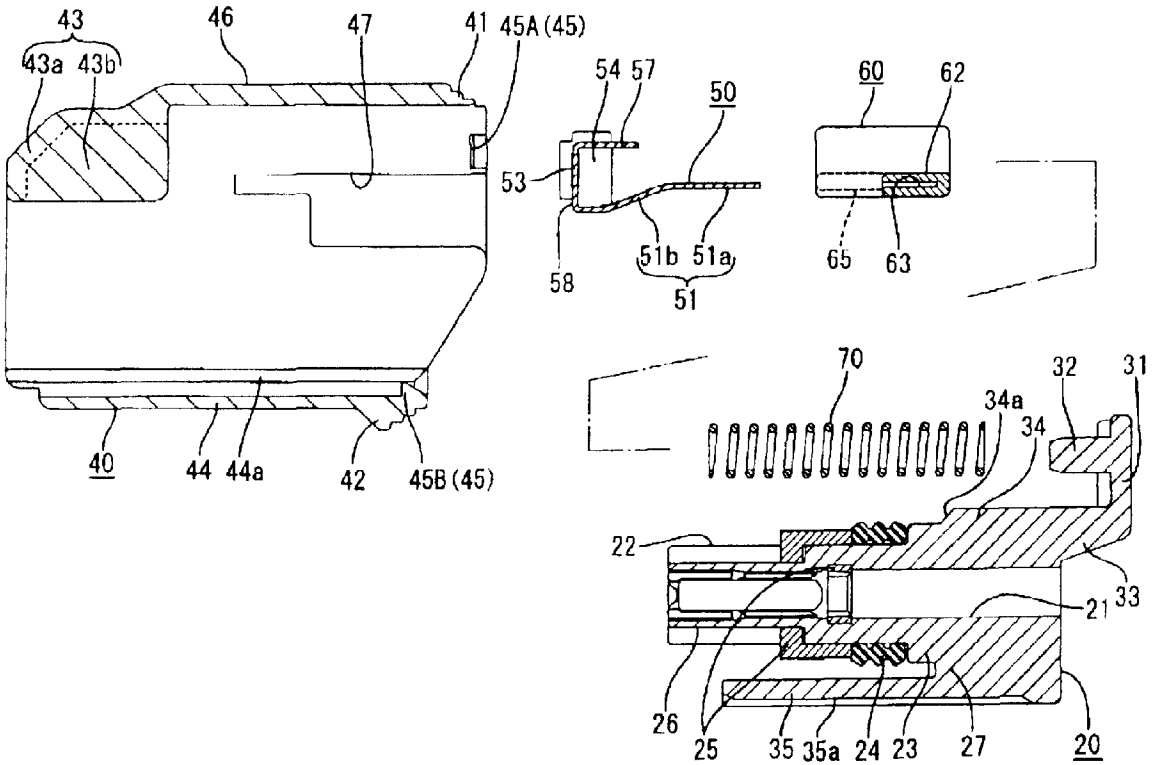
FIG. 5 is an exploded section along 5—5 of FIG. 1.

The rear stepped portion 27 of the terminal accommodating portion 22 is transversely asymmetric when viewed from the front. However, transversely symmetrical push canceling portions 34 are formed on upper parts of the rear stepped portion 27 at positions aligned with the spring supports 31. The push canceling portions 34 are at substantially the same height as the bottom of the lock arm 28. Both push canceling portions 34 have a substantially flat shape with slanted front surfaces 34*a* that slope up and to the back, as shown in FIGS. 2 and 5. A guide rail 35 projects at a substantially widthwise center of the bottom surface of the lower part of the rear stepped portion 27 and has a substantially inverted T-shaped cross section, as shown in FIG. 1. The guide rail 35 extends substantially along forward and backward directions and has substantially the same length as the lock arm 28. A forwardly open groove 35*a* is formed centrally in the lower surface of the guide rail 35.

The connector also has a cover 40 in the form of a wide frame made e.g. of a synthetic resin. The cover 40 is at least as long as the female housing 20 and substantially surrounds the entire periphery of the female housing 20 from the front to the rear of the female housing 20.

The cover 40 is stepped to have a narrow upper portion 40*a* of less than half, and preferably about ⅕ of the height of the cover 40, and a wide lower portion 40*b* (FIG. 1). The front surface of the wide portion 40*b* is vertically straight and substantially perpendicular to the connecting direction CD. However, the front surface of the narrow portion 40*a* slopes up and to the back. Operable portions 41, 42 are provided at the rear end of the upper surface of the narrow portion 40*a* and at the rear end of the bottom surface of the wide portion 40*b* over substantially the entire widths. The operable portions 41, 42 are stepped to bulge out more toward the front so that they can be pushed from behind. The lower operable portion 42 is formed by causing the wider portion 40*b* to project down. The front surface of the lower operable portion 42 is slanted down and to the back so that the lower operable portion 42 can be pulled from the front. A retainer insertion hole (not shown) is formed in the right surface of the wider portion 40*b* in FIG. 1 and the retainer 25 is insertable sideways into the retainer insertion hole.

Two front-stops 43 bulge down at opposite sides of the front end of the narrow portion 40*a* and the lock arm 28 of the female housing 20 is insertable between the front-stops 43. Each front-stop 43 has a front wall 43*a* that extends substantially along the front surfaces of the narrow portion 40*a* and the wide portion 40*b*. Upper parts of the front wall 43*a* are slanted to the back when viewed sideways (see FIG. 4). The front stop 43 also has a rib 43*b* that extends back from the front wall 43*a*. The rib 43*b* is substantially T-shaped when viewed from behind (see FIG. 3). Additionally, each rib 43*b* has length that is preferably less than half, and more preferably about ⅓, of the entire length of the cover 40. A raised portion 46 is formed on the top of the narrow portion 40*a*. Front sections of the raised portion 46 extend along width areas corresponding to the front-stops 43 and extend to the rear from locations near the rear ends of the ribs 43*b*. However, rear sections of the raised portion 46 extend over substantially the entire width of the narrow portion 40*a* (see FIG. 2). The operable portion 41 is formed at the rear end of the raised portion 46.

A guide receiving portion 44 bulges down at substantially the widthwise middle of the lower part of the wide portion 40*b* for receiving the guide rail 35 of the female housing 20. Two supports 44*a* are provided at the upper ends of the inner edges of the bulge for supporting jaws of the guide rail 35. The guide rail 35 can be brought into sliding contact with the guide receiving portion 44 to guide relative displacements of the cover 40 and the female housing 20 forward and backward substantially along the connecting direction CD.

Three holding projections 45 project in from the inner periphery of the rear end of the cover 40 (hereinafter, suffixes A, B are attached to distinguish the upper and lower holding projections 45). The rear surfaces of the holding projections 45 are slanted. Thus, the female housing 20 is assembled from behind the cover 40 and can easily move over the holding portions 45. The front surfaces of the holding projections 45 are substantially normal to forward and backward directions and fixedly engage the rear end surfaces of the female housing 20. In this way, the cover 40 is supported against further forward movement on the female housing 20. Conversely, the female housing 20 is supported against further backward with respect to the cover 40. In the above holding state, the female housing 20 is covered by the cover 40 over substantially the entire length and periphery. The position of the cover 40 with respect to the female housing 20 at this time is referred to as an initial mount position (see FIG. 8).

The two upper holding projections 45A are formed on the inner surfaces of the sides connecting the narrow portion 40*a* and the wide portion 40*b*. Two mold-removal holes are formed in the front surface of the cover 40 for the removal of a mold for forming the two upper holding projections 45A (see FIG. 1). Both upper holding projections 45A are engageable with the rear end surfaces of the spring receiving portions 31 of the female housing 20. The lower holding projection 45B is formed at substantially the widthwise center of the bottom inner surface of the wider portion 40*b*, and hence on the inner surface of the guide receiving portion 44. The lower holding projection 45B is about twice the height of the two upper holding projections 45A. The lower holding projection 45B is engageable with the rear end surface of the guide rail 35 of the female housing 20.

The connector further includes resilient members 50 formed by bending, folding and/or embossing a metallic plate material stamped out or cut into a specified shape. Each resilient member 50 includes an arm 51 extending along substantially forward and backward directions. The arm 51 is resiliently deformable along a substantially vertical direction normal to the connecting direction CD and is bent at an intermediate position so that a rear portion 51*a* is substantially horizontal while a front portion 51*b* slopes down to the front. Two biting projections 52 are provided at opposite sides of the rear end of the arm 51. A spring pressing portion 53 projects from the front end of the arm 51 for supporting the front end of the compression coil spring 70. Two side plates 54 are provided at opposite sides of the front portion 51*b* of the arm 51 and abut against opposite side edges of the spring pressing portion 53. The front end of the compression coil spring 70 is held between the side plates 54. Two holding pieces 55 project from opposite side edges of the spring pressing portion 53 and are inserted into holding holes 56 in the side plates 54. Thus, the spring pressing portion 53 is held substantially straight and vertical. Portions of the side plates 54 corresponding to the holding holes 56 project more forward than the spring pressing portion 43. An engaging piece 57 is formed by making a pair of slits at an upper end of the spring pressing portion 53 and bending the section between the slits backward. The engaging piece 57 is slightly narrower than the inner diameter of the compression coil spring 70 and hence fits into the front end of the compression coil spring 70.

The connector also includes a slide 60 made e.g. of a synthetic resin. The slide 60 includes a bridge 61 and two holding portions 62 extend from the bridge 61 for holding the resilient members 50. The slide 60, with the resilient members 50 mounted therein, is displaceable forward and back substantially along the connecting direction CD with respect to the cover 40 and the female housing 20. The bridge 61 has a wide upper portion and two sides that project down from the opposite ends of the upper portion. The holding portions 62 are connected with the sides. An escaping portion is formed over a specified width of a rear side of an upper part of the bridge 61 (see FIG. 2). Each holding portion 62 has a main body 62*a* with a holding groove 63 and the rear portion 51*a* of the arm 51 of the resilient member 50 can be pressed into the holding groove 63 from the front. Two sides 62*b* project forward from the opposite ends of the main body 62*a*, and the side 62*b* toward the center is coupled to the bridge 61. A U-shaped insertion groove 64 is formed in the upper surface of the main body 62*a* to accommodate the compression coil spring 70. With the arm 51 of the resilient member 50 pressed in the holding groove 63 of the main body 62*a*, the arm 51 is resiliently displaceable substantially vertically in a direction substantially normal to the connecting direction CD about the rear portion 51*a*. Accordingly, the front portion 51*b*, the spring pressing portion 53 and the like are vertically displaceable (see FIG. 11(B)). A space slightly wider the arm 51 is defined between the opposite sides 62*b* to guide the arm 51 into the holding groove 63.

A guiding projection 65 projects sideways from the outer side surface of the outer side portion 62*b* of each holding portion 62. Additionally, two backwardly open guiding grooves 47 are formed on the inner side surfaces of the wide portion 40*b* of the cover 40 right below the holding projections 45A (see FIGS. 3 and 4). The guiding projections 65 are insertable into guiding grooves 47, and are held in sliding contact with the guiding grooves 47 for guiding the movement of the slide 60 with respect to the cover 40. The upper end of each guiding groove 47 is substantially straight along forward and backward directions. However the lower end of each guiding groove 47 is stepped down at an intermediate position to facilitate insertion of the guiding projections 65 during assembly of the slide 60 and the resilient members 50 (see FIG. 4).

A movable operating portion 80 is formed in an upper part of the cover 40 at a position before the upper operable portion 41 for indirectly pressing the lock arm 28 from outside. A substantially U-shaped slit 81 is formed in the movable operating portion 80 to define a cantilevered arm 82 supported at its front end. The arm 82 is resiliently deformable along a vertical direction substantially normal to the connecting direction CD about a supported portion at the front end. An operable projection 83 projects from the upper surface at the rear end of the arm 82 to a height slightly above the raised portion 46 and the operable portion 41. The operable projection 83 is stepped to project up toward the back. Thus, the cover 40 can be pulled back from front and simultaneously the movable operating portion 80 can be pressed down. The operable projection 83 is substantially surrounded by the raised portion 46. Thus, it is difficult for the operable projection 83 to get caught by a wire or the like from the front. An unlock pressing portion 84 projects down from the lower surface at the rear end of the arm 82 and can press the unlock guide 30 of the lock arm 28. A slanted surface 84*a* is sloped up and to the back on the rear surface of the unlock pressing portion 84 and substantially conforms to the slanted surface 30*a* of the unlock guide 30.

The unlock pressing portion 84 is slightly higher than the upper end of the unlock guide 30 when the arm 82 is in an unbiased state (see FIG. 8). Thus, the movable operating portion 80 is at an inoperable position when the arm 82 is in the unbiased state and the unlock pressing portion 84 neither interferes with nor contacts the unlock guide 30. On the other hand, the operable projection 83 can be pressed down to deform the arm 82 into a position where the unlock pressing portion 84 overlaps the unlock guide 30 with respect to height direction HD. Thus, the movable operating portion 80 is deformed into an operable position where the unlock pressing portion 84 can interfere with the unlock guide 30. In this way, the movable operating portion 80 is vertically displaceable between the inoperable position where the lock arm 28 is inoperable and the operable position where the lock arm 28 is operable. The movable operable portion remains at the inoperable position unless the arm 82 is deformed by pressing the operable projection 83.

Figure 6:
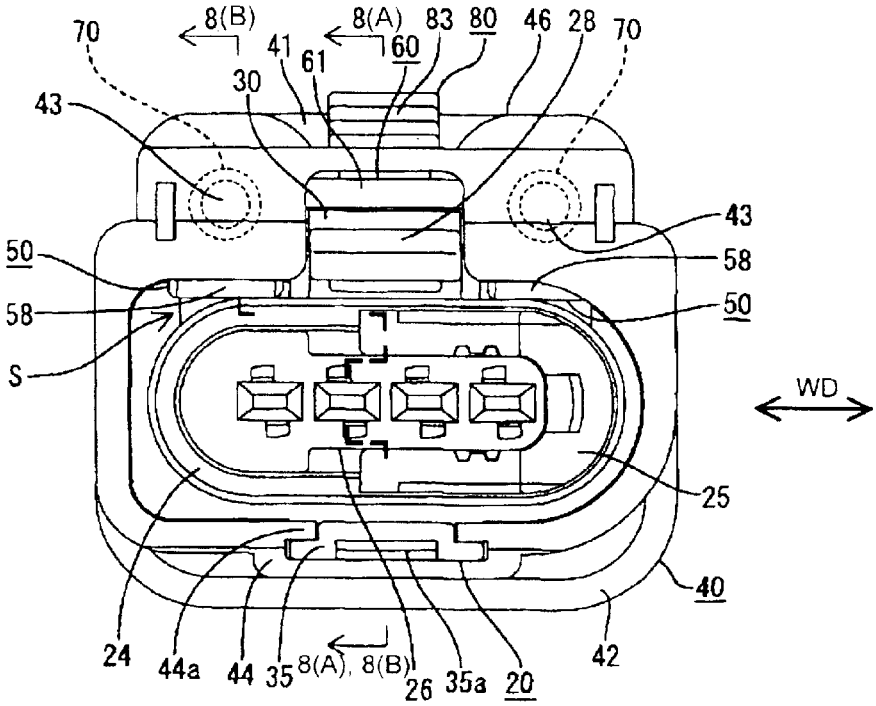
FIG. 6 is a front view with the cover assembled to the female housing.
Figure 7:
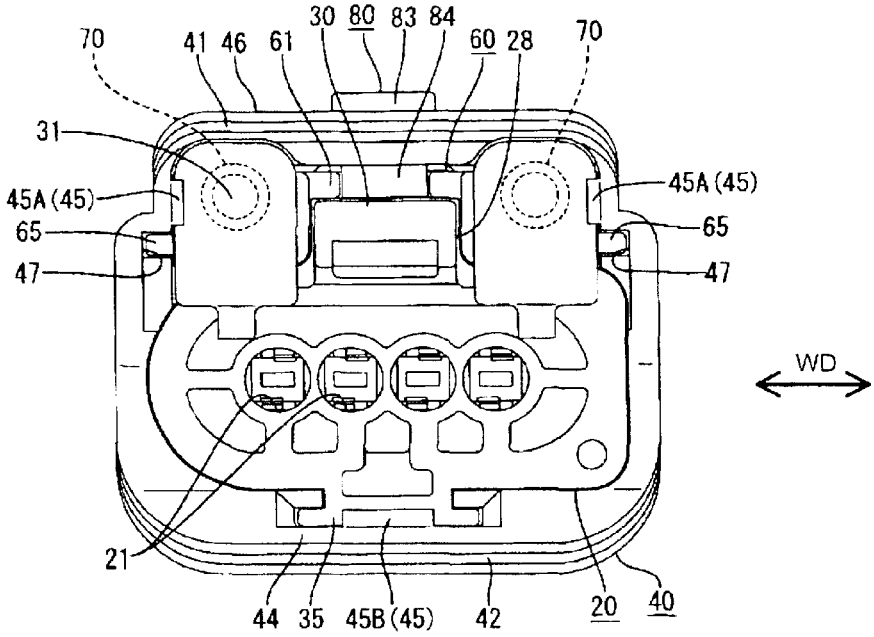
FIG. 7 is a rear view with the cover assembled to the female housing.

The female housing 20, cover 40, compression coil springs 70, slide member 60 and resilient members 50 are assembled into the state shown in FIGS. 6 to 8. In this assembled state, the cover 40 is held at the initial mount position (FIG. 8) by the holding projections 45 and cannot move further forward with respect to the female housing 20. The compression coil springs 70 are compressed slightly between the spring receiving portions 31 of the female housing 20 and the spring pressing portions 53 of the resilient members 50, which are held in contact with the front-stops 43 of the cover 40. In other words, the cover 40 is held at the initial mount position by the compression coil springs 70 and will not move any further back with respect to the female housing 20. Further, the bridge 61 of the slide 60 substantially surrounds the lock arm 28 and the holding portions 62 of the slide 60 are held substantially horizontally along the upper surface of the push canceling portion 34. The guiding projections 65 enter the guide grooves 47 and are held in contact with the front edges of the guide grooves 47, and the downwardly-sloped front portions 51*b* of the arms 51 of the resilient members 50 face the push canceling portion 34 from the front. At this stage, the pushable portions 58 at the bottom ends of the spring pressing portions 53 are in the connection space S and can be pushed back as the front end surface 10*a* of the receptacle 11 of the male housing 10 enters the connection space S.

The female connector 20 can be assembled by pressing the rear portions 51*a* of the arms 51 of the resilient members 50 into the holding grooves 63 of the slide 60 in a state shown in FIGS. 4 and 5. At this time, the biting projections 52 bite in the inner edges of the holding grooves 63 to give a sufficient holding force. Alternatively, the resilient members 50 may be connected integrally to the slide 60 by insert molding or the like. The assembly of the resilient members 50 and the slide 60 is inserted into the cover 40 from behind until the spring pressing portions 53 contact the front-stops 43 and the guiding projections 65 reach the front edges of the guiding grooves 47. Additionally, the engaging pieces 57 fit into the front ends of the compression coil springs 70, which also are held in contact with the rear surfaces of the spring pressing portions 53.

The female housing 20 is mounted into the cover 40 along the connecting direction from behind, and the guide rail 35 is advanced in the guide receiving portion 44 until the female housing 20 reaches the initial mount position (FIG. 8). Then, as shown in FIG. 8, the holding projections 45 engage the rear end surface of the female housing 20. In this way, the cover 40 is prevented from being displaced forward from the initial mount position with respect to the female housing 20. In this process, the engaging projections 32 fit into the rear ends of the compression coil springs 70 and the spring receiving portions 31 contact the rear end surfaces of the compression coil springs 70. Thus, the compression coil springs 70 are held slightly resiliently compressed between the spring pressing portions 53 and the spring receiving portions 31. Further, the holding portions 62 of the slide 60 move onto the push canceling portions 34 of the rear step 27 to be held substantially horizontally. The groove 35*a* makes the guide rail 35 easier to move over the holding projection 45B.

The connection space S is defined between the cover 40 and the terminal accommodating portion 22, and the pushable portions 58 at the bottom ends of the spring pressing portions 53 of both resilient members 50 are located in this connection space S, as shown in FIGS. 6 and 8. Further, the female terminal fittings, the retainer 25, the seal ring 24 and the like are mounted into the female housing 20. It should be noted that the respective parts can be assembled in an order and by a method other than the above order and method. For example, the female housing 20 may be assembled with the cover 40 after the compression coil springs 70 are mounted into the female housing 20.

Figure 9A:
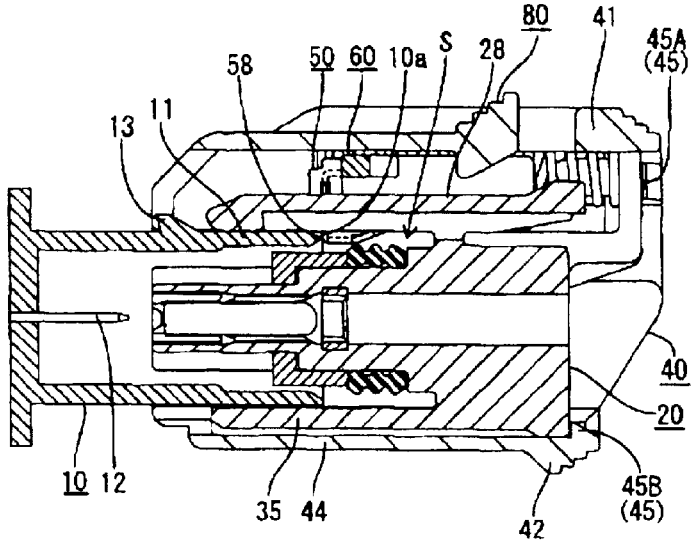
FIGS. 9(A) and 9(B) are sections similar to FIGS. 8(A) and 8(B), but show a state where the front end surface of a receptacle contacts pushable portions while the two connectors are being connected.
Figure 9B:
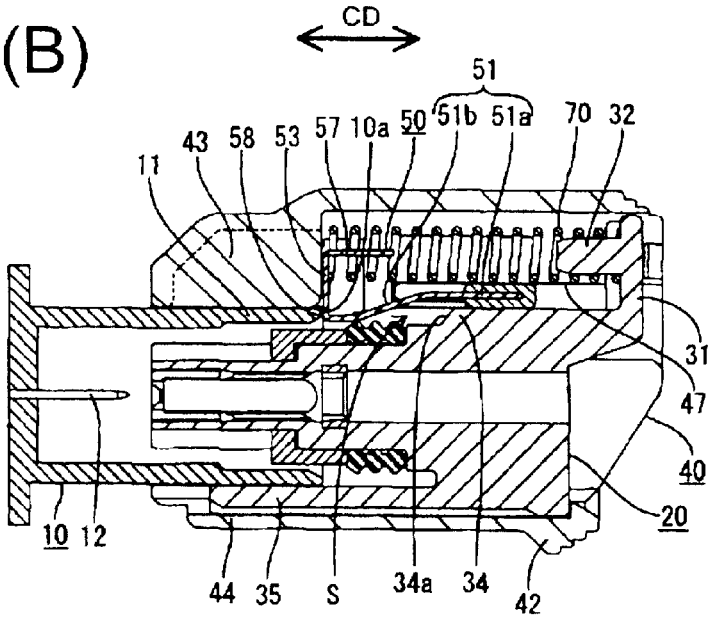

Connection proceeds by aligning the receptacle 11 with the connection space S and pushing both operable portions 41, 42 of the cover 40 forward along the connecting direction CD. This connecting operation also may be performed by pushing the rear end of the female housing 20. At this time, the cover 40 is held at the initial mount position by the holding projections 45 and cannot move any further forward with respect to the female housing 20. As a result, the female housing 20 is connected with the male housing 10 together with the cover 40. The front end surface 10*a* of the receptacle 11 contacts the pushable portions 58 of both resilient members 50 when the receptacle 11 reaches a specified depth in the connection space S, as shown in FIG. 9. Thus, both resilient members 50 and the slide 60 are moved back together by the front end surface 10*a* of the receptacle 11 as the connection progresses. At this time, both compression coil springs 70 are compressed by the backward movements of the spring pressing portions 53 that support the front ends of the compression coil springs 70, and the compression coil springs 70 accumulate biasing forces to separate the two housings 10, 20 (see FIG. 10(B)). In this process, the lock arm 28 moves onto the lock 13 and is displaced resiliently (see FIG. 10(A)).

The connecting operation could be interrupted while the two housings 10, 20 are only partly connected. In this situation, the biasing forces accumulated thus far in the compressed compression coil springs 70 are released, and the pushable portions 58 of the resilient members 50 push the front end surface 10*a* of the receptacle 11 back to separate the two connectors 10, 20. This prevents the two housings 10, 20 from being left partly connected.

Figure 10A:
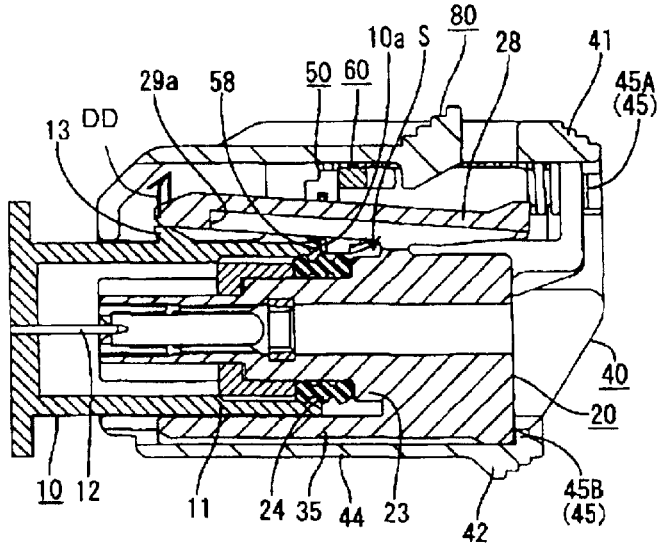
FIGS. 10(A) and 10(B) are sections similar to FIGS. 8(A) and 8(B), but show a lock arm displaced resiliently while the connectors are being connected.
Figure 10B:
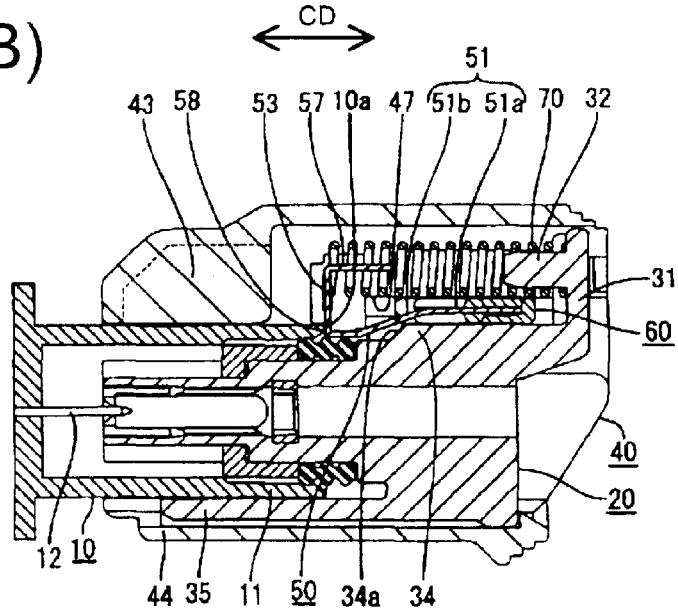

Both resilient members 50 and the slide 60 are moved back as the connection proceeds. Sufficient backward movement causes the downwardly-sloped front portions 51*b* of the arms 51 to contact and move onto the push canceling portions 34, as shown in FIG. 10(B). Thus the front portions 51*b* of the arms 51 are deformed up in a resilient deformation direction RDD about the rear portions 51*b* thereof. The upward deformation of the front portions 51*b* of the arms 51 moves the spring pressing portions 53 and the pushable portions 58 up in the resilient deformation direction RDD, and areas of engagement of the pushable portions 58 and the front end surface 10*a* of the receptacle 11 gradually decrease. Immediately before the housings 10, 20 are connected properly, the pushable portions 58 are displaced sufficiently in the resilient deformation direction RDD to disengage completely from the front end surface 10*a* of the receptacle 11 as shown in FIG. 11(B). As a result, the resilient members 50 and the slide 60 are no longer prevented from moving forward. Both compression coil springs 70 therefore are released and both resilient members 50 and the slide 60 are permitted to move forward as indicated by phantom in FIG. 11(B).

Figure 11A:
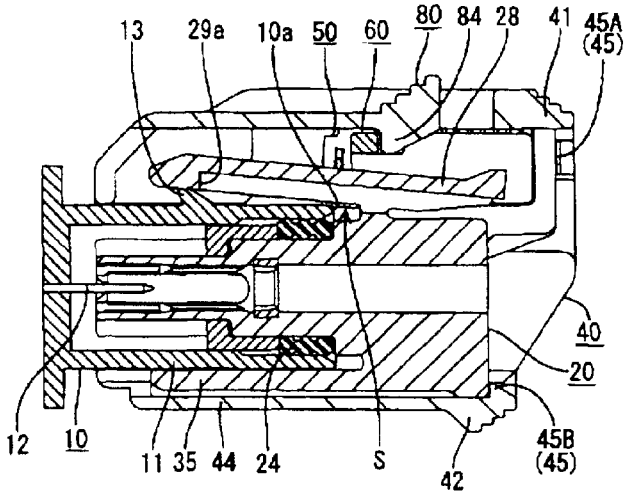
FIGS. 11(A) and 11(B) are sections similar to FIGS. 8(A) and 8(B), but show the pushable portions disengaged from the front end surface of the receptacle immediately before the two housings are properly connected.
Figure 11B:
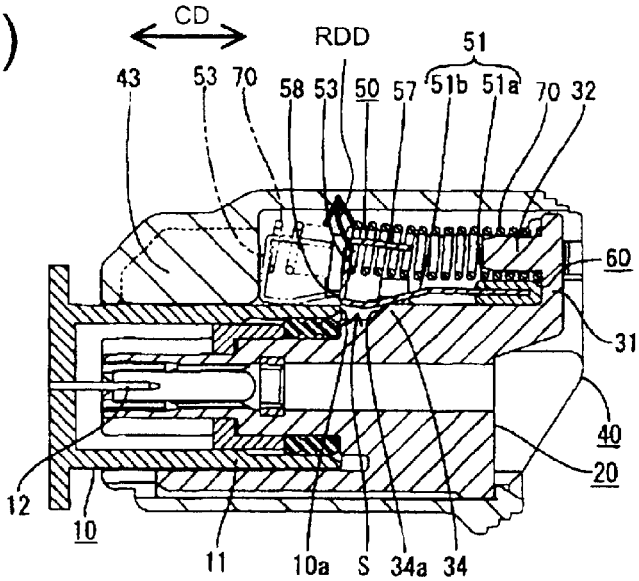

Pushing forces on the cover 40 and the contact of the spring pressing portions 53 of the forward-moving resilient members 50 with the front-stops 43 generate inertia that exists when the housings 10, 20 reach a position immediately before proper connection, as shown in FIG. 11. As a result, the housings 10, 20 can be pushed automatically substantially to a proper depth of connection. Thus, a degree of compression of the compression coil springs 70 in the connecting process can be made smaller as compared to a case where compression coil springs are compressed until two housings are connected properly. As a result, a force necessary for the connection can be reduced.

Figure 12A:
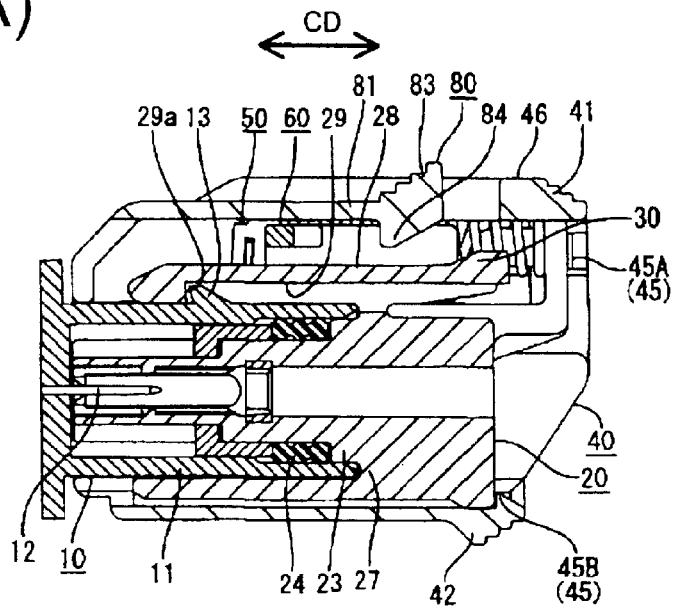
FIGS. 12(A) and 12(B) are sections similar to FIGS. 8(A) and 8(B), but show the lock arm engaged with a lock after the housings are connected properly and a state where the resilient members and the slide are moved forward after the two housings are properly connected, respectively.
Figure 12B:
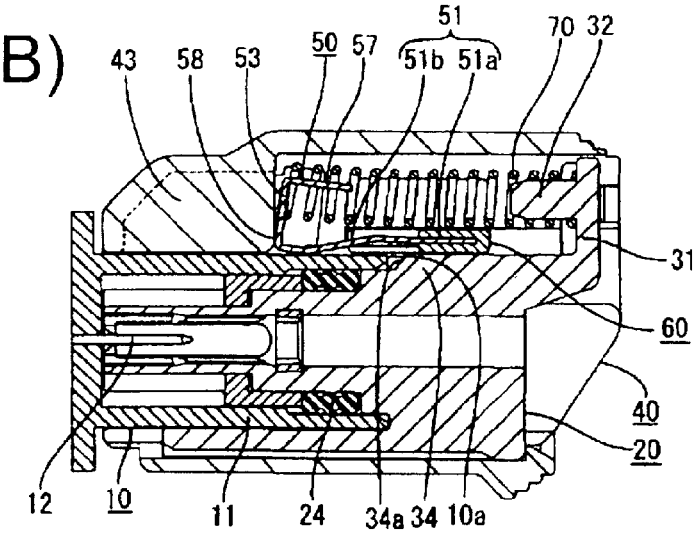

The lock arm 28 is deformed resiliently and moves over the lock 13 as the two housings 10, 20 are being connected. The lock arm 28 then resiliently returns when the housings are connected properly and the front end surface 29*a* of the groove 29 engages the rear end surface of the lock 13 as shown in FIG. 12(A). Thus, the two housings 10, 20 are locked together in the properly connected state. The arms 51 of the resilient members 50 have moved forward and are supported on the upper surface of the receptacle 11 when the housings 10, 20 are in the properly connected state shown in FIG. 12(B). Additionally, the arms 51 of the resilient members 50 are deformed resiliently in the resilient deformation direction RDD, and the spring pressing portions 53 contact the front-stops 43 while being inclined backward. At this time, the guiding projections 65 of the slide 60 are in contact with the front edges of the guiding grooves 47. Further, the male and female terminal fittings are connected electrically with each other, and the seal ring 24 is held in close contact with the inner peripheral surface of the receptacle 11 and the outer peripheral surface of the terminal accommodating portion 22 to provide waterproofing between the two housings 10, 20.

There is a possibility that the cover 40 could be moved back from the properly connected state, for example, because the cover 40 gets caught from the front by a wire or other external matter. In such a case, a locked state of the housings could be canceled inadvertently in a connector with a mechanism to displace a lock arm automatically as a cover is moved back. However, in this embodiment, the movable operating portion 80 remains at the inoperable position unless the arm 82 is deformed resiliently by pressing the operable projection 83 down. Thus, the unlock pressing portion 84 does not interfere with the unlock guide 30 even if the cover 40 is moved back. As a result, an undesirable event where the lock arm 28 is displaced inadvertently can be avoided. Further, the operable projection 83 is surrounded at opposite sides and at the back by the raised portion 46 of the narrow portion 40*a*. Therefore, wires and the like are unlikely to interfere with the operable projection 83.

The two housings 10, 20 may have to be separated from each other for maintenance or some other reason. In such a case, the lower operable portion 42 of the cover 40 and the operable projection 83 of the movable operating portion 80 are pulled back to move the cover 40 back with respect to the female housing 20. Additionally, the operable projection 83 is pressed down to deform the arm 82. As a result, the movable operating portion 80 is displaced from the inoperable position to the operable position. At this time, the spring pressing portions 53 of both resilient members 50 are supported by the front-stops 43 and cannot move any further forward. Therefore, the spring pressing portions 53 are pushed back by the front-stops 43 as the cover 40 is moved backward. Further, the guiding projections 65 of the slide 60 are pushed back by the front edges of the guiding grooves 47. Thus, both resilient members 50 and the slide 60 are moved back with respect to the female housing 20 together with the cover 40 and the compression coil springs 70 are compressed resiliently.

Figure 13A:
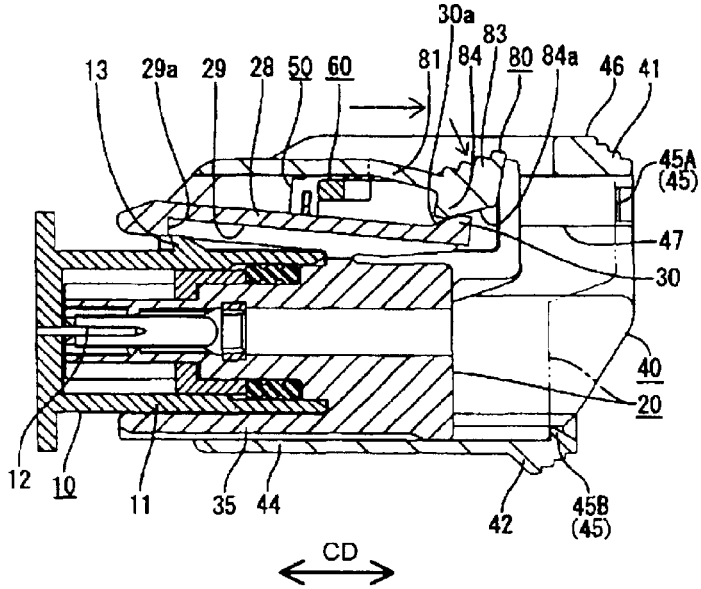
FIGS. 13(A) and 13(B) are sections similar to FIGS. 8(A) and 8(B), but show a state where the lock arm is displaced resiliently while the housings are being separated and a state where the resilient members and the slide are moved back together with the cover while the housings are being separated, respectively.
Figure 13B:
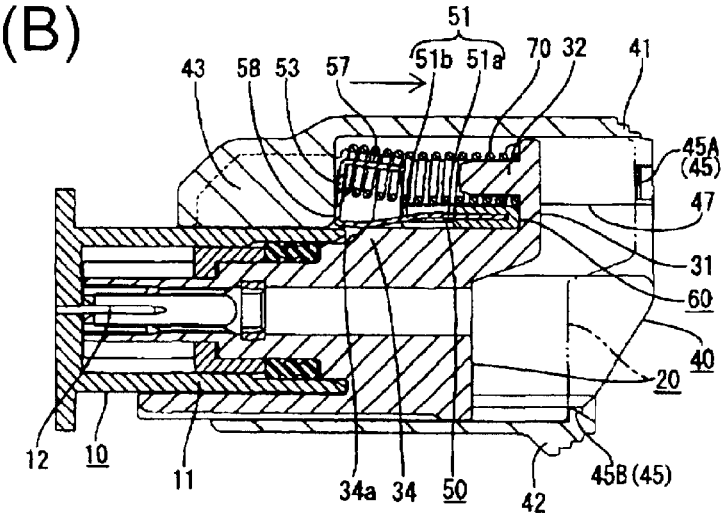
Figure 14A:
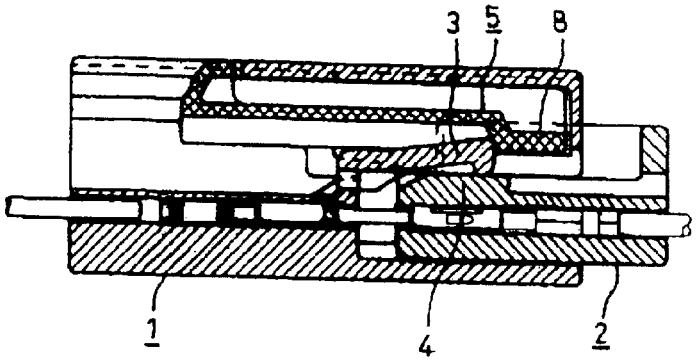
FIG. 14(A) PRIOR ART
FIGS. 14(A) and 14(B) are a section along a lock arm and a section along a spring showing a partly connected state of a prior art connector.
Figure 14B:
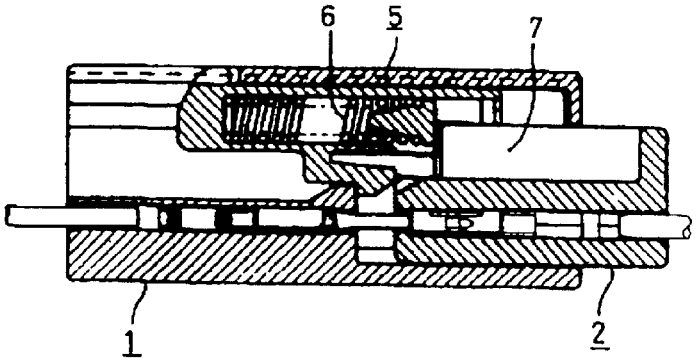
FIG. 14(B) PRIOR ART
Figure 15A:
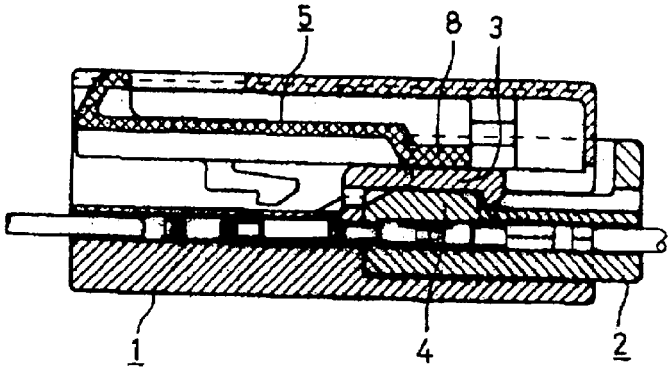
FIG. 15(A) PRIOR ART
FIGS. 15(A) and 15(B) are a section along the lock arm and a section along the spring showing a properly connected state of the prior art connector.
Figure 15B:
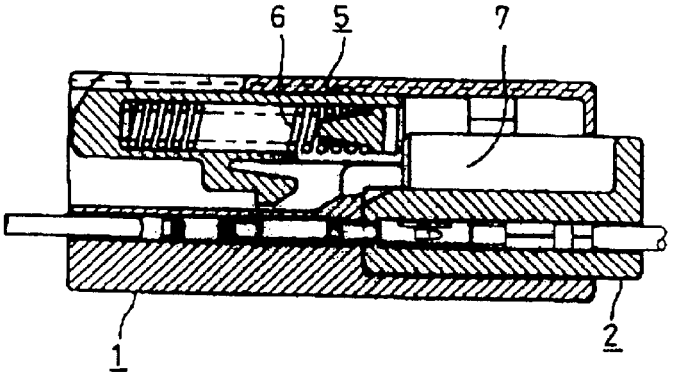
FIG. 15(B) PRIOR ART

The slanted surface 84*a* of the unlock pressing portion 84 of the movable operating portion 80 is brought into contact with the slanted surface 30*a* of the unlock guide 30 when the cover 40 is moved back to a specified position. Further backward movement of the cover 40 causes the unlock pushing portion 84 to push the unlock guide 30. This pushing force is translated by the slanted surface 30*a* into a force that pushes the rear end of the lock arm 28 down. Thus, as shown in FIG. 13(A), the lock arm 28 is displaced resiliently in the deformation direction DD to disengage the front end surface 29*a* of the groove 29 from the rear end surface of the lock projection 13. The locked state of the two housings 10, 20 is canceled in this way. Thus, the biasing forces of the compression coil springs 70 are released and the female housing 20 is moved back, as indicated by phantom in FIG. 13, with respect to the cover 40, the resilient members 50, the slide 60 and the male housing 10, and the lock arm 28 returns. At this time, the cover 40 is moved further back, taking advantage of backward-acting forces exerted on the cover 40 due to the contact of the backward-moving female housing 20 with the respective holding projections 45. As a result, the male housing 10 can be pulled apart from the female housing 20. Accordingly, the female housing 20 can be pulled apart from the male housing 10 by pulling the cover 40 back in this way. Further, the movable operating portion 80 is displaced from the inoperable position to the operable position by successively pulling the cover 40 and pressing the operable projection 83, thereby resiliently displacing the lock arm 28. Thus, separating operability is good.

The operable projection 83 of the movable operating portion 80 does not have to be pressed down at the start of the exertion of pulling forces on the cover 40. For example, the operable projection 83 may be pressed down after the cover 40 is moved back to the position shown in FIG. 13. Alternatively, the operable projection 83 may be pressed while the cover 40 is being moved back.

As described above, separation of the housings 10, 20 is achieved by operating the cover 40 in substantially the same direction as the female housing 20 is moved during separation. Therefore, separating operability is good. Further, the lock arm 28 cannot be operated unless the movable operating portion 80 is displaced from the inoperable position to the operable position during the separating operation. Thus, the lock state of the properly connected housings 10, 20 cannot be canceled inadvertently. Furthermore, the two housings 10, 20 can be connected with and separated from each other by operating the cover 40. Accordingly, operability is better as compared to connectors in which a female housing is operated at the time of a connecting operation and a cover is operated at the time of a separating operation.

The pushable portions 58 of the resilient members 50 are pushed by the front end surface 10*a* of the male housing 10. Thus, the construction of the male housing 10 is simple. If the pushable portions 58 of the resilient members 50 are pushed by the front end surface 10*a* of the male housing 10 in this way, the arms 51 of the resilient members 50 are kept on the receptacle 11 and resiliently deformed in the resilient deformation direction RDD with the two housings 10, 20 properly connected. However, the resilient members 50 are made of a metal in the preferred embodiment. Thus, the resiliency is difficult to deteriorate with time as compared, for example, to a case where they are made of a resin.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The compression coil springs are released immediately before the housings are connected properly in the foregoing embodiment. However, the partial connection preventing function of the housings can be displayed more securely by setting the compression coil springs to be released at the same time the housings are connected properly or after the housings are connected properly.

The spring pressing portions of the resilient members and the guiding projections of the slide are supported so as not to move any further forward by the front-stops and the guiding grooves of the cover in the foregoing embodiment. However, either the resilient members or the slide may be supported so as not to move any further forward by the cover according to the present invention. Further, the slide may be omitted according to the present invention.

The operable member in the foregoing embodiment is the cover that surrounds the female housing. However, connectors with an operable member that does not surround a female housing may be embraced by the invention.

Although the resilient members are made of a metal in the foregoing embodiment, resilient members made of a material other than a metal may be used in the present invention.

The compression coil springs, the resilient members and the like are assembled with the female housing and the resilient members are pushed by the male housing in the foregoing embodiment. However, the constructions of the male and female housings may be reversed according to the invention.

Compression coil springs are the biasing members in the foregoing embodiment. However, leaf springs, resilient rods or the like may be used.

The seal ring makes the connector of the foregoing embodiment watertight. However, the invention is also applicable to nonwatertight connectors.

What is claimed is:

1. A connector having a housing connectable with a mating housing of a mating connector, the housing comprising:

a lock arm resiliently engageable with a lock of the mating housing when the housing is connected properly with the mating housing;

at least one resilient member movable along a connecting direction of the two housings and resiliently displaceable along a direction intersecting the connecting direction, the resilient member being pushable backward by a pushing portion on the mating housing in the process of connecting the two housings;

a biasing member provided between the resilient member and the housing and resiliently compressible while accumulating a biasing force to separate the two housings as the resilient member is moved backward; and an operable member movable substantially along the connecting direction, the operable member comprising a movable operating portion displaceable between an operable position where the lock arm can be operated to cancel the locked state of the lock arm with the lock and an inoperable position where the lock arm cannot be operated.

2. The connector claim 1, wherein the housing comprises at least one canceling portion for resiliently displacing the resilient member into a position for canceling a pushed state by the pushing portion substantially as the housings become connected properly.

3. The connector of claim 2, wherein the operable member is assembled with the housing and held against further forward movement.

4. The connector of claim 3, wherein the operable member supports the resilient member so that the resilient member does not move further forward.

5. The connector of claim 1, wherein the resilient member is made of a metal.

6. The connector of claim 1, wherein the pushing portion is a front-end surface of the mating housing.

7. The connector of claim 1, wherein the operable member is movable substantially in a removing direction of the housing for bringing the movable operating portion to the operable position.

8. The connector of claim 1, wherein the movable operating portion comprises an operable projection at least partly surrounded by at least one raised portion on the operable member.

9. The connector of claim 8, wherein the raised portion comprises a slanted front surface sloped up and to the back.

10. The connector of claim 1, wherein the operable member is held at the initial mount position by the biasing member so as not to move any further backward with respect to the housing.

11. The connector of claim 1, wherein the movable operating portion can be displaced from the inoperable position to the operable position by successively pressing an operable projection of the operable member after at least partly pulling the operable member to displace the lock arm.

12. A connector assembly, comprising:

a mating housing having a pushable portion and a lock; and a housing connectable with the mating housing, the housing having a resiliently deflectable lock arm engageable with the lock of the mating housing when the housing is connected properly with the mating housing, at least one resilient member movable along a connecting direction of the two housings, and resiliently displaceable along a direction intersecting the connecting direction, the resilient member being pushable backward by the pushable portion of the mating housing in the process of connecting the two housings, a spring provided between the resilient member and the housing and resiliently compressible while accumulating a biasing force to separate the two housings as the resilient member is moved back, and an operable member movable along the connecting direction, the operable member comprising a movable operating portion displaceable between an operable position where the lock arm can be operated to cancel the locked state of the lock arm with the lock and an inoperable position where the lock arm cannot be operated.

* * * * *